US006222928B1

(12) United States Patent
Downs, Jr. et al.

(10) Patent No.: US 6,222,928 B1
(45) Date of Patent: Apr. 24, 2001

(54) UNIVERSAL IMPEDANCE MATCHER FOR A MICROPHONE-TO-RADIO CONNECTION

(75) Inventors: Edward F. Downs, Jr., Lynn Haven; Kevin M. Venturella, Panama City Beach, both of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/307,475

(22) Filed: May 10, 1999

(51) Int. Cl.[7] ..... H04R 3/00
(52) U.S. Cl. ..... 381/111; 381/114
(58) Field of Search ..... 381/111, 114

(56) References Cited

U.S. PATENT DOCUMENTS 4,535,205 * 8/1985 Ravinet et al. ..... 381/114
5,036,536 * 7/1991 Hanon et al. ..... 379/387
5,185,789 * 2/1993 Hanon et al. ..... 379/395

* cited by examiner

*Primary Examiner*—Forester W Isen
*Assistant Examiner*—Brian Tyrone Pendleton
(74) *Attorney, Agent, or Firm*—Harvey A. Gilbert; Donald G. Peck

(57) ABSTRACT

An impedance matching circuit couples a microphone's output to a radio's microphone input. A tap circuit is coupled to the microphone's output for extracting an audio signal therefrom. An amplifier circuit having DC blocking circuitry is coupled to the tap circuit. An audio transformer is also provided with its primary and secondary windings defining a turns ratio of approximately 1:1. The primary winding has a characteristic DC resistance that is less than approximately 100 ohms. The secondary winding has an impedance that is within a prescribed impedance range of the microphone input. A driver circuit is coupled between the amplifier circuit and audio transformer for continuously driving the audio transformer.

14 Claims, 2 Drawing Sheets

UNIVERSAL IMPEDANCE MATCHER FOR A MICROPHONE-TO-RADIO CONNECTION

ORIGIN OF THE INVENTION

The invention described herein was made in the performance of official duties by employees of the Department of the Navy and may be manufactured, used, licensed by or for the Government for any governmental purpose without payment of any royalties thereon.

1. Field of the Invention

The invention relates generally to microphone-to-radio connections, and more particularly to an impedance matcher that allows a microphone (e.g., a powered piezoelectric microphone) to automatically be impedance matched to almost any two-way radio.

2. Background of the Invention

Military and civilian two-way radios are typically designed for use with a specific microphone. In each case, the microphone's impedance value is matched to an input impedance of its corresponding radio. Typical input impedances for HF, VHF, or SATCOM radios fall between the broad range of 5–2000 ohms. Thus, interchanging microphones (necessitated by failure, breakage, lost, etc.) between radios often results in an impedance mismatch between microphone and radio. The impedance mismatch can cause a significant reduction in the microphone's apparent performance.

As mentioned above, microphones are subject to failure and breakage. This is especially true in rugged environments. Accordingly, the U.S. Navy has developed a waterproof, powered, piezoelectric microphone that operates extremely well in rugged and high-noise environments. However, as also mentioned above, the number of different types of radios used by the military means that impedance matching of the microphone to the different radios is a time consuming and costly endeavor. Eliminating risk of a mismatch during operations and minimizing inventory requirements are two major benefits.

SUMMARY OF THE INVENTION

Accordingly, it is an object of the present invention to provide an impedance matcher that would allow a microphone to be automatically impedance-matched to a variety of radios.

Another object of the present intention is to provide an impedance matcher for use with powered microphones.

Still another object of the present invention is to provide an impedance matcher that is small and economical to build.

Other objects and advantages of the present invention will become more obvious hereinafter in the specification and drawings.

In accordance with the present invention, an impedance matching circuit couples a microphone's output to a radio's microphone input. The input impedance for the microphone input is within a prescribed range. A tap circuit is coupled to the microphone's output for extracting an audio signal therefrom. The audio signal has an AC component and a DC component. An amplifier circuit having DC blocking circuitry is coupled to the tap circuit for passing the AC component and blocking the DC component. An audio transformer is also provided with its primary and secondary windings defining a turns ratio of approximately 1:1. Further, the primary winding has a characteristic DC resistance that is less than approximately 100 ohms and the secondary winding has an impedance that is within the prescribed range of the input impedance for the microphone input. A driver circuit is coupled between the amplifier circuit and audio transformer for continuously driving the audio transformer with the AC component.

DETAILED DESCRIPTION OF THE INVENTION

Figure 1:
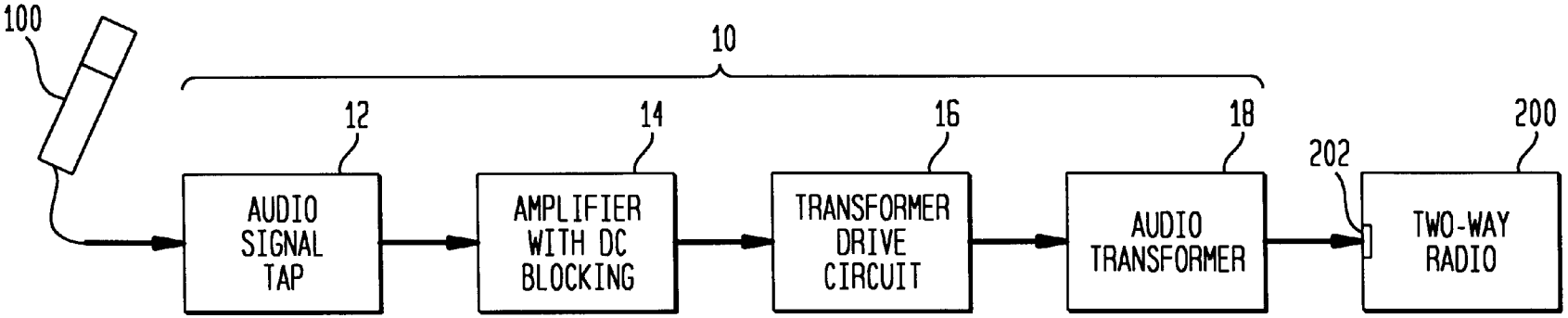
FIG. 1 is a functional block diagram of the impedance matching circuit according to the present invention.

Referring now to the drawings, and more particularly to FIG. 1, an impedance matching circuit according to the present invention is illustrated and referenced generally by numeral 10. Impedance matching circuit 10 is used to couple a microphone 100 to a two-way radio 200. More specifically, impedance matching circuit 10 matches the output impedance of microphone 100 to the input impedance of a microphone input 202 of radio 200. For purposes of the present invention, it will be assumed that input 202 has an input impedance that falls within an expected prescribed range such as 5–2000 ohms as is generally the case with HF, VHF and SATCOM radios. Microphone 100 is representative of both powered and non-powered microphones. Microphone 100 is connected to an audio signal tap circuit 12 that extracts the audio signal from microphone 100. If microphone 100 is a powered microphone, tap circuit 12 includes a power source and resistance element as will be described further below by way of a specific example. The audio signal output from tap circuit 12 includes an AC and DC component.

An amplifier 14 with DC blocking circuitry is connected to tap circuit 12. Amplifier 14 blocks the DC component of the audio signal while amplifying the AC component. The DC blocking capability provided by amplifier 14 insures that audio transformer 18 does not get "saturated" which could desensitize audio transformer 18 to the AC component of the audio signal. The gain of amplifier 14 can be pre-set to a value that provides acceptable performance for a few types of radio 200. The gain of amplifier 14 could also be adjustable by means of a gain control for greatest versatility as will be described further below.

The amplified AC component of the audio signal is then passed to the series combination of a transformer drive circuit 16 and an audio transformer 18. Audio transformer 18 should have a primary-to-secondary winding turns ratio of approximately 1:1. Further, the secondary winding of audio transformer 18 should have an impedance that falls within the prescribed range (e.g., 5–2000 ohms) of radios that might be used with the impedance matching circuit 10. The secondary winding of audio transformer 18 should also have a low characteristic DC resistance on the order of approximately 100 ohms or less. Since audio transformer 18 represents a low impedance load, transformer drive circuit 16 is coupled between amplifier 14 and audio transformer 18. One such drive circuit that is used to drive low impedance loads is an emitter follower circuit.

Figure 2:
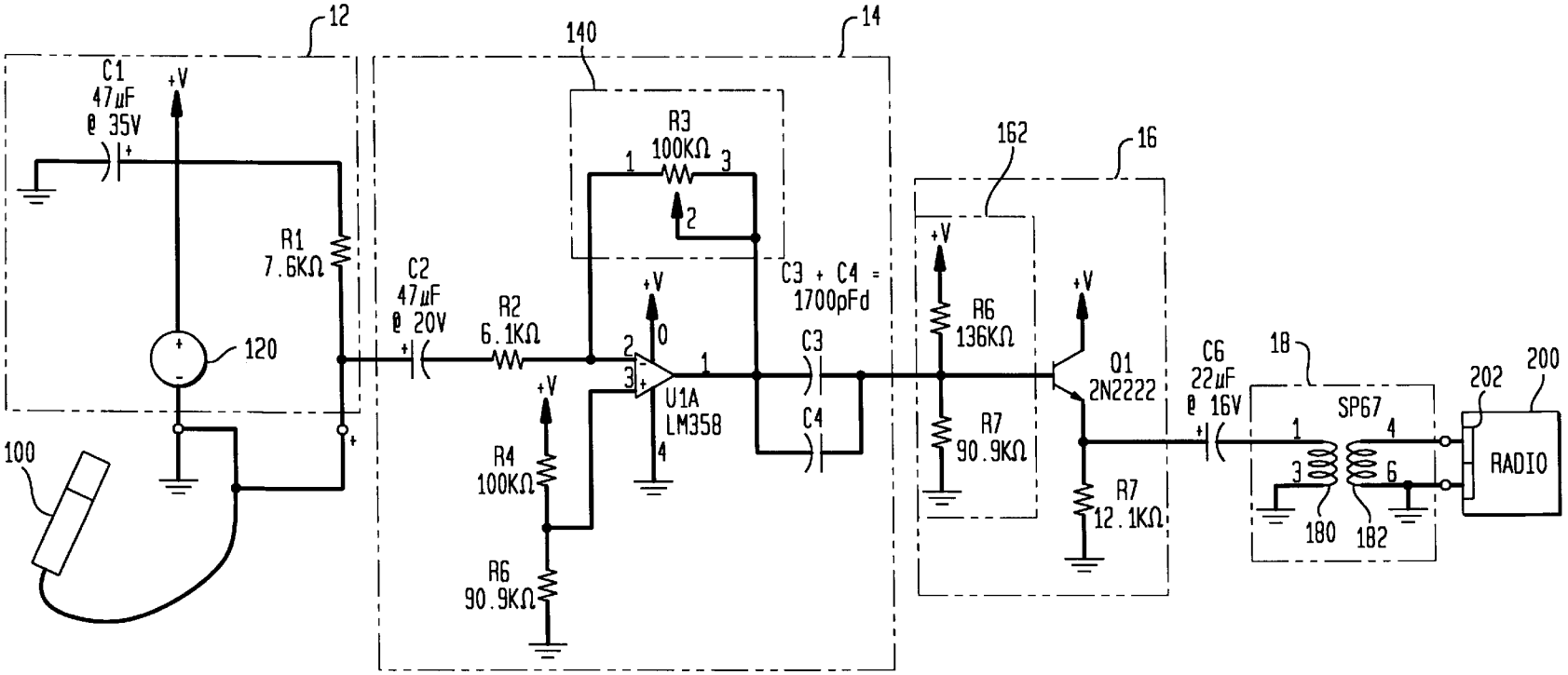
FIG. 2 is a schematic diagram of one circuit implementation of the present invention.

As illustrated in FIG. 2, the present invention will now be explained by way of example for use with a powered microphone 102 designed by the U.S. Navy and disclosed in an allowed U.S. patent application Ser. No. 08/136,856, filed Oct. 18, 1993, entitled "Surface Laminated Piezoelectric Film Sound Transducer", the contents of which are hereby incorporated by reference. The output of microphone 102 is connected to tap circuit 12. More specifically, the output of microphone 102 is coupled across a combination of a power source 120 (e.g., a battery) and a resistor R1 serving as a pull-up resistor that allows microphone 102 to receive power. Note that if the microphone is a non-powered microphone, resistor R1 is not needed. A smoothing capacitor C1 can be coupled to power source 120 if necessary. For microphone 102 described in the above-noted patent application, power source 120 should be able to supply 5–30 volts DC.

Figure 3:
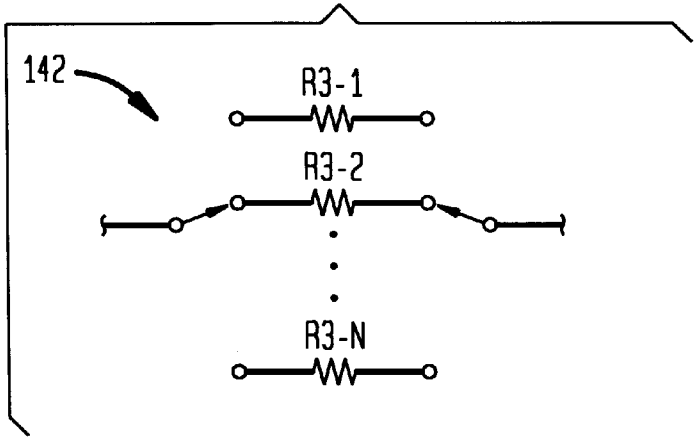
FIG. 3 is a schematic diagram of an alternative gain control adjustment that can be used in the present invention.

The AC and DC components of the audio signal extracted from tap circuit 12 are amplified and blocked, respectively, at amplifier 14 where capacitors C2, C3 and C4 block the DC component. The gain of amplifier 14 can be adjusted over a range of gains by a continuously variable gain control adjustment 140, e.g., a potentiometer. Alternatively, as illustrated in FIG. 3, a gain control 142 can be used in place of gain control 140 to provide a number of predetermined discrete resistances R3-1, R3-2, . . . , R3-N, any one of which can be selected by a user. While gain control 140 provides for fine tuning of impedance matching circuit 10 to achieve the optimum performance at radio 200, gain control 142 is not subject to drift. The presence of either gain control 140 or 142 allows the present invention to adapt to high-noise environments.

The AC audio signal is passed to transformer drive circuit 16, which continuously drives audio transformer 18 with the AC audio signal. In the illustrated example, drive circuit 16 is an NPN transistor Q1 connected in an emitter follower configuration. More specifically, the base of transistor Q1 is coupled to amplifier 14 and the emitter of transistor Q1 is coupled to primary winding 180 of audio transformer 18. In order to insure that transistor Q1 is always in the ON state so that audio transformer 18 is always being driven with the AC signal, a biasing circuit 162 is coupled to the base of transistor Q1.

The output of drive circuit 16 is coupled to primary winding 180 of audio transformer 18. Because biasing circuit 162 introduces DC voltage into drive circuit 16, a capacitor C5 can be coupled between drive circuit 16 and audio transformer 18 to block any DC voltage passed thereto. As mentioned above, the turns ratio of primary winding 180 to secondary winding 182 should be approximately 1:1. The impedance of secondary winding 182 should fall within the input impedance of microphone input 202 and the characteristic DC resistance of secondary winding 182 should be less than approximately 100 ohms. In terms of microphone 102, a good economical choice for audio transformer 18 was the SP67 from MagnaTek, Goodland, Ind.

The advantages of the present invention are numerous. Impedance matching circuit 10 allows a microphone to be used with a variety of types of radios without significant loss of performance. The present invention was field-tested for the above-referenced U.S. Navy-designed microphone in a variety of noisy environments and found to provide excellent performance when connected to radios having microphone input impedance of 5, 1000 and 2000 ohms. Since the circuit can be built with off-the-shelf discrete electronic components, its design is both economical and small. The present invention will be useful in both military and civilian applications.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An impedance matching circuit for coupling a microphone's output to a radio's microphone input wherein an input impedance for said microphone input is within a prescribed range, comprising:

a tap circuit coupled to a microphone's output for extracting an audio signal therefrom, said audio signal having an AC component and a DC component;

an amplifier circuit having DC blocking circuitry, said amplifier circuit coupled to said tap circuit for passing said AC component and blocking said DC component;

an audio transformer having a primary winding and a secondary winding wherein a turns ratio of approximately 1:1 is defined, said primary winding having a characteristic DC resistance that is less than approximately 100 ohms and said secondary winding having an impedance that is within said prescribed range of said input impedance for said microphone input; and a driver circuit coupled between said amplifier circuit and said audio transformer for continuously driving said audio transformer with said AC component.

2. An impedance matching circuit as in claim 1 wherein said tap circuit comprises:

a power source; and a resistance element coupled to said power source, wherein said microphone's output is coupled across a combination of said power source and said resistance element.

3. An impedance matching circuit as in claim 2 wherein said power source comprises a battery.

4. An impedance matching circuit as in claim 1 wherein said driver circuit comprises:

an emitter follower circuit having a transistor with its base coupled to said amplifier circuit and its emitter coupled to said audio transformer; and a biasing circuit coupled to said base for continuously biasing said emitter follower circuit in an ON state.

5. An impedance matching circuit as in claim 4 wherein said transistor is an NPN transistor.

6. An impedance matching circuit as in claim 1 wherein said amplifier circuit includes a gain control for adjusting the gain of said amplifier circuit.

7. An impedance matching circuit as in claim 6 wherein said gain control provides continuous adjustment over a range of gains for said amplifier circuit.

8. An impedance matching circuit as in claim 6 wherein said gain control provides for adjustment to one of a plurality of discrete pre-determined gains for said amplifier circuit.

9. An impedance matching circuit for coupling a powered microphone's output to a radio's microphone input wherein an input impedance for said microphone input is within a prescribed range of approximately 5–2000 ohms, said impedance matching circuit comprising:

a power source;

a resistance element coupled to said power source, wherein said microphone's output is coupled across a combination of said power source and said resistance element;

an adjustable gain amplifier circuit having DC blocking circuitry, said adjustable gain amplifier circuit coupled between said resistance element and said microphone's output;

an audio transformer having a primary winding and a secondary winding wherein a turns ratio of approximately 1:1 is defined, said primary winding having a characteristic DC resistance that is less than approximately 100 ohms and said secondary winding having an impedance that is within said prescribed range of 5–2000 ohms; and an emitter follower driver circuit coupled between said adjustable gain amplifier circuit and said audio transformer for continuously driving said audio transformer.

10. An impedance matching circuit as in claim 9 wherein said adjustable gain amplifier circuit includes a gain control providing continuous adjustment over a range of gains for said adjustable gain amplifier circuit.

11. An impedance matching circuit as in claim 9 wherein said adjustable gain amplifier circuit includes a gain control providing for adjustment to one of a plurality of discrete pre-determined gains for said adjustable gain amplifier circuit.

12. An impedance matching circuit as in claim 9 wherein said power source comprises a battery.

13. An impedance matching circuit as in claim 12 wherein said emitter follower driver circuit comprises:

an emitter follower circuit having a transistor with its base coupled to said amplifier circuit and its emitter coupled to said audio transformer; and a biasing circuit coupled to said base for continuously biasing said emitter follower circuit in an ON state.

14. An impedance matching circuit as in claim 13 wherein said transistor is an NPN transistor.

* * * * *